United States Patent [19]

Andersen et al.

[11] 4,175,815

[45] Nov. 27, 1979

[54] CONNECTOR ELEMENT WITH MEANS FOR REDUCING EFFECTS OF RADIAL VOID IN ELECTRICAL CONNECTION

[75] Inventors: Charles E. Andersen; Craig W. Simons, both of Hackettstown, N.J.

[73] Assignee: Amerace Corporation, New York, N.Y.

[21] Appl. No.: 911,157

[22] Filed: May 31, 1978

[51] Int. Cl.[2] ..... H01R 13/52; H01R 15/06

[52] U.S. Cl. ..... 339/61 R; 339/143 C

[58] Field of Search ..... 339/59 R, 59 M, 60 R, 339/60 C, 60 M, 61 R, 61 C, 61 M, 94 R, 94 C, 111, 143 R, 143 C; 174/73 R

[56] References Cited

U.S. PATENT DOCUMENTS 3,594,696 7/1971 Witek, Jr. ..... 339/60 M

*Primary Examiner*—Neil Abrams

*Attorney, Agent, or Firm*—Richard A. Craig; Arthur Jacob

[57] ABSTRACT

A radial void present at the juncture of interengaged electrical connector elements in an electrical connection is reduced in size and relocated to a position of lesser electrical stress by a flexible annular lip integral with one of the connector elements and urged, in response to completion of the connection, into the void.

7 Claims, 5 Drawing Figures

CONNECTOR ELEMENT WITH MEANS FOR REDUCING EFFECTS OF RADIAL VOID IN ELECTRICAL CONNECTION

The present invention relates generally to electrical connections and pertains, more specifically, to an improved construction for reducing and rendering essentially benign voids ordinarily present in electrical connections made between mating electrical connector elements.

When complementary electrical connector elements are interengaged to establish an electrical connection, a radial interface is present along confronting surfaces at the juncture of the mated connector elements. Under ideal conditions, the radial interface should be free of air so as to preserve the electrical integrity of the connection, as attained by the electrical properties of the materials from which the connector elements are constructed. However, under actual, more practical conditions, the mating configurations of the connector elements do not achieve perfect alignment and air voids or gaps are bound to be present at the radial interface. Such radial voids are the result of the manufacturing tolerances in the mating components, the renitence of the elastomeric materials used in the construction of the components, and component designs which often require a positive stop or locking arrangement at another juncture in the connection. The presence of a radial void or gap in the connection introduces the possibility of ionization of the air in the void under high voltage conditions with the concomitant creation of sharp discontinuities in the electric field distribution, resulting in reduced dielectric strength in the connection.

It is an object of the present invention to improve the performance of an electrical connection between interengaged electrical connector elements by reducing the size of any void at the radial interface between confronting surfaces at the juncture of the mated connector elements.

Another object of the invention is to enhance the performance of the electrical connection by moving or relocating any such void to a position of lower electrical stress within the connection.

Still another object of the invention is to reduce the size of the void or gap at the radial interface between confronting surfaces of mated connector elements in an electrical connection, or to relocate the gap to a position of lower electrical stress, over a wide range of gap sizes arising out of manufacturing tolerances.

A further object of the invention is to reduce or relocate radial voids or gaps within an electrical connection between interengaged connector elements without engendering excessive axial forces which would tend to separate the connector elements at the juncture between the connector elements.

A still further object of the invention is to attain the above-described reduction or relocation of radial voids in electrical connections without a radical departure from the design and construction of present electrical connector elements.

The above objects, as well as further objects and advantages, are attained by the present invention which may be described briefly as providing, in an electrical connector element, such as a connector elbow, which is to be connected to a complementary electrical connector element, such as a high voltage bushing in a power distribution system, the complementary connector elements including axially-extending interengageable mating portions and radially-extending surfaces which will confront one another upon interengagement of the mating portions: a housing member including at least a first part of insulating material, at least a portion of the radially-extending surface extending along the first part; and an annular lip of insulting material integral with the first part of the housing member and extending axially beyond at least the portion of the radially-extending surface, adjacent the intersection of the radially-extending surface and the mating portion, the lip being flexible such that upon interengagement of the complementary mating portions the lip will be flexed outwardly so as to extend radially between the confronting radially-extending surfaces and at least partially fill any gap between the confronting surfaces upon completion of the connection.

The invention will be more fully understood, while still further objects and advantages will become apparent, in the following detailed description of an embodiment thereof illustrated in the accompanying drawing, in which.

Figures 1, 2:
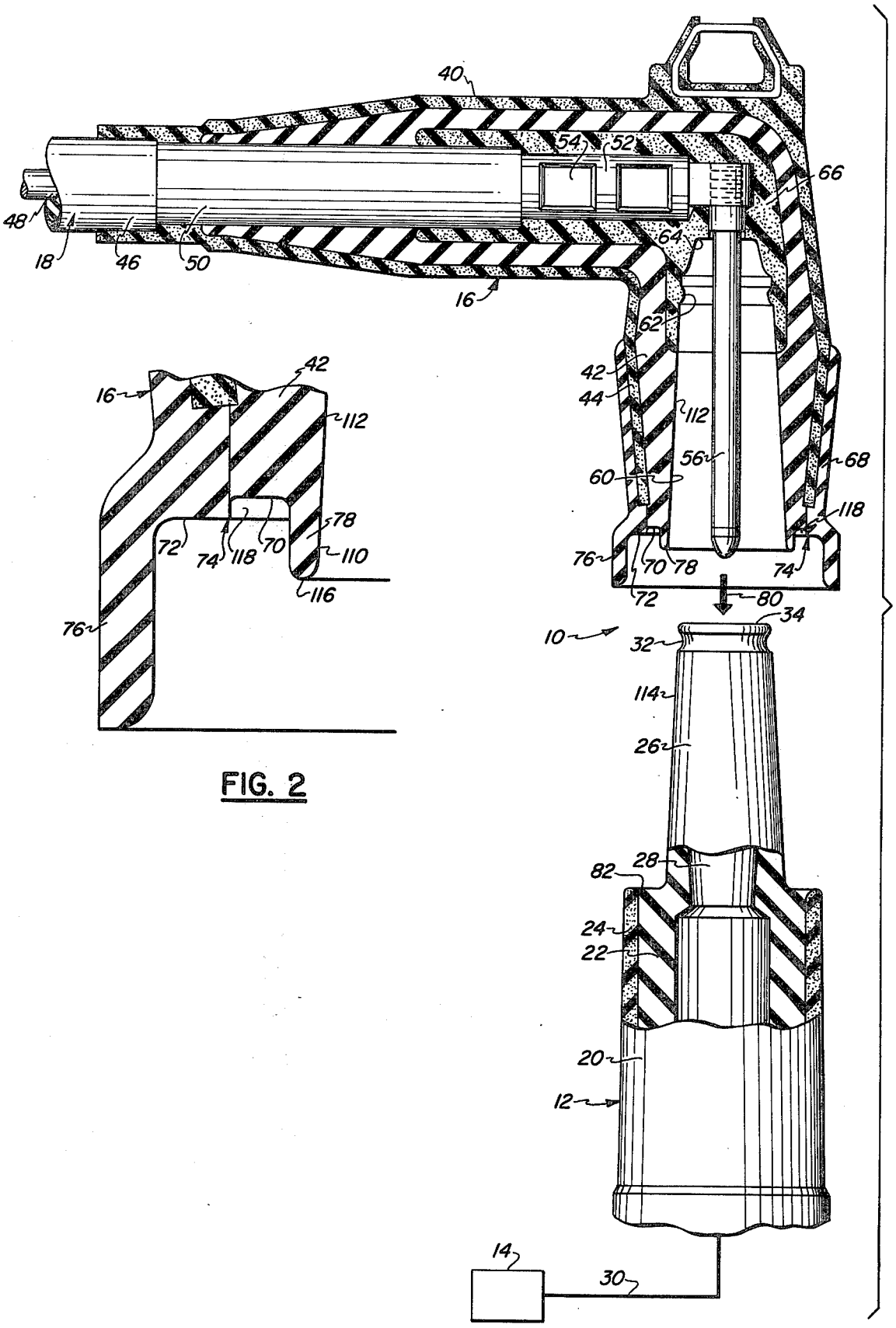
FIG. 1 is an exploded, longitudinal elevational view, partially sectioned, of an electrical connection employing a connector element constructed in accordance with the invention.
FIG. 2 is an enlarged fragmentary view of a portion of FIG. 1.

Referring now to the drawing, and especially to FIGS. 1 and 2 thereof, an electrical connection 10 is to be made between complementary connector elements shown in the form of a high voltage bushing 12, which is a part of a power distribution system shown diagrammatically at 14, and a connector elbow 16, which has been affixed to the terminal end of a high voltage electrical cable 18.

Bushings like bushing 12 are common in power distribution systems, bushing 12 having a body member 20 which is constructed of an elastomeric material, body member 20 including an insulating portion 22 and a conductive portion 24. An axially-extending mating portion is shown in the form of a plug 26 which carries a socket assembly 28 therein, the socket assembly 28 being electrically connected to a lead 30 in the power distribution system 14. An annular detent groove 32 is located adjacent the top end 34 of the bushing 12.

Elbow 16 has a composite housing member 40 which includes a first part 42 of insulating elastomeric material and a second part 44 of conductive elastomeric material surrounding the first part 42 and molded integral with first part 42. Second part 44 is electrically connected to the shield 46 of cable 18. The conductor 48 of cable 18, which is surrounded by insulation 50, carries a fitting 52 which has been affixed to the terminal end of conductor 48, as by crimping the fitting 52 at 54. A connector pin 56 is threaded into fitting 52 and extends axially along the central axis of a receptacle 60 which serves as an axially-extending mating portion of elbow 16, to be interengaged with plug 26 of bushing 12. A raised detent ring 62 is placed adjacent the inner end 64 of the receptacle 60. A third part 66 of conductive elastomeric material is molded integral with first part 42 and surrounds the fitting 52, as well as portions of insulation 50 and pin 56, to serve as an internal conductive shield, as is now well-known in the art. A fourth part is shown in the form of an insulating cuff 68 located at the open end of the elbow 16.

First part 42 terminates at a radially-extending end surface portion 70, while cuff 68 includes a radially-extending end surface portion 72. Portions 70 and 72 together make up a radially-extending end surface 74 which extends radially outwardly from adjacent the receptacle 60 to an axially-extending collar 76 in the cuff 68. An annular lip 78 extends axially beyond end surface portion 70 adjacent the intersection of surface 74 and receptacle 60, lip 78 being unitary with first part 42. Lip 78 has a relatively thin cross-section so as to be rather flexible, for purposes which now will be explained.

Figure 4:
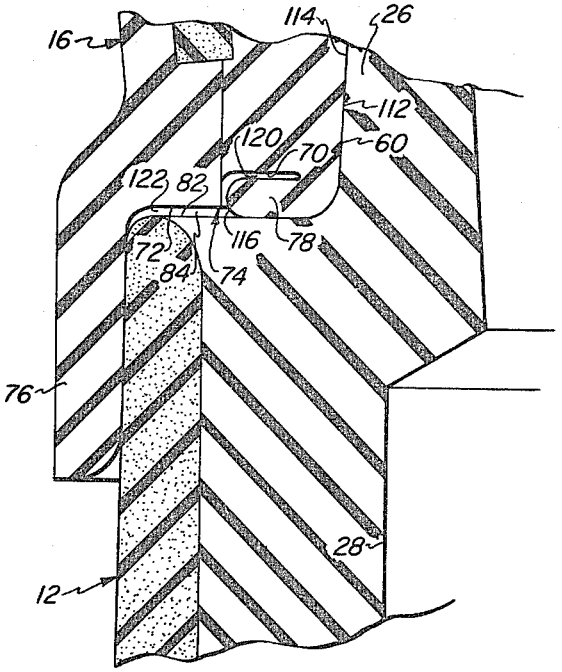
FIG. 4 is an enlarged fragmentary view of a portion of FIG. 3.
Figure 3:
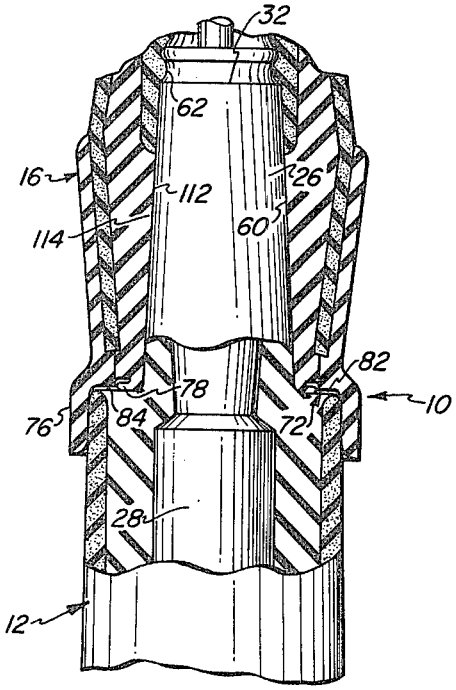
FIG. 3 is a fragmentary view showing portions of the completed connection of FIG. 1.
Figure 5:
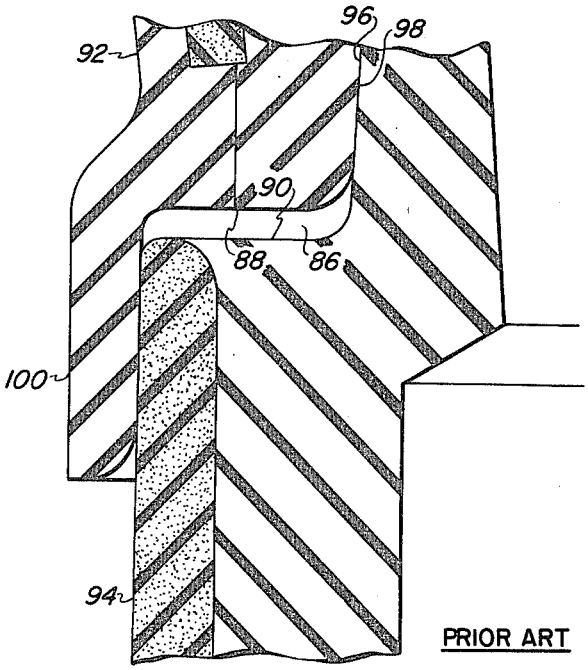
FIG. 5 is a view similar to FIG. 4, but illustrating a prior art construction.

Turning now to FIGS. 3, 4 and 5, as well as to FIGS. 1 and 2, in order to complete a connection between bushing 12 and elbow 16, connector pin 56 is inserted into socket assembly 28 and plug 26 is interengaged with receptacle 60. Axial relative movement between the bushing 12 and elbow 16, in the direction of arrow 80 in FIG. 1, will seat the elbow 16 on bushing 12 and complete the connection. When the connection is complete, detent ring 62 is seated in detent groove 32 to serve as a positive locking arrangement for connection 10.

At the other end of receptacle 60, radially-extending end surface 74 confronts a generally complementary radially-extending surface 82 on the bushing 12. In view of the manufacturing tolerances in the fabrication of bushing 12 and elbow 16, the confronting surfaces 74 and 82 at that juncture of the connection 10 do not necessarily come into perfect engagement when the detent ring 62 is properly seated in detent groove 32. Hence, there is present at the interface between confronting surfaces 74 and 82 a slight void or gap 84.

In corresponding prior art components, as shown in FIG. 5, a similar gap 86 usually is present between confronting surfaces 88 and 90 of an elbow 92 and a bushing 94, respectively. Gap 86 extends between the interengaged plug 96 and receptacle 98 and the collar 100 of elbow 92. Air in the gap 86 will be stressed by the voltage across the gap in a radial direction between the interengaged plug and receptacle and the collar. Under high voltage conditions, the air will ionize, creating a sharp discontinuity in the electric field distribution, resulting in reduced dielectric strength in the connection.

In the present construction, as shown in FIGS. 3 and 4, lip 78 is flexed radially outwardly, in response to the interengagement of bushing 12 and elbow 16 so that the gap 84 is at least partially filled by the lip 78. The presence of lip 78 thus reduces the volume of gap 84, with a concomitant reduction of the effects of ionization of air in the gap 84. At the same time, the bulk of gap 84 is spaced radially outwardly, away from the interengaged plug 26 and receptacle 60, to a position of lower electrical stress, thereby further reducing any deleterious effects of air in the gap and tending to render benign the presence of air in the gap.

As best seen in FIGS. 2 and 4, lip 78 has a radially inner surface 110 preferably extending axially coextensive with the internal interface surface 112 of receptacle 60, which internal interface surface 112 is complementary to external interface surface 114 of plug 26. The relationship among the surfaces 110, 112 and 114, together with the relatively thin cross-section of lip 78 and the rounded tip 116 of the lip, assures that lip 78 will be flexed radially outwardly in response to completing the connection 10 and will not resist such flexure with any significant axial force which might otherwise tend to separate the elbow 16 from bushing 12. In the preferred construction, radially-inner end surface portion 70 is recessed axially relative to radially-outer end surface portion 72 to form an annular pocket 118, and the axial length of lip 78 is limited so as not to exceed a length which will assure that the tip 116 of lip 78 will not extend radially beyond surface portion 70, i.e., beyond the overall radius of pocket 118. In addition, the axial depth of pocket 118 is approximately equal to the radial thickness of lip 78. In this manner lip 78 will become seated within pocket 118 so that the size of any portion of gap 84 in first part 42 is reduced to a minimum and the bulk of the gap is relocated outwardly nearer cuff 68, where electrical stresses are reduced. Furthermore, any air in the portion 120 of gap 84 located behind lip 78 will not be trapped within portion 120 as the volume of that portion is reduced by squeezing lip 78 into pocket 118. Rather, such air will be displaced into radially outer portion 122 of gap 84, in a position of lesser electrical stress.

It will be noted that the addition of lip 78 to elbow 16 represents a minimal change in the design and construction of the elbow as compared to conventional elbows, yet the advantages achieved are significant. Thus, manufacture of elbow 16 is economical. Furthermore, elbow 16 is compatible with existing bushings in the field, rendering the elbow immediately acceptable for integration into current product lines.

In addition, the increased performance attained through the use of lip 78 enables elbow 16 to be utilized at higher ratings than would be available without the lip. For example, an elbow having all of the dimensions of elbow 16, but without lip 78, and ordinarily rated for use at 25 Kv, can be rated for use at 35 Kv with the addition of lip 78. Thus, the use of lip 78 attains significantly improved performance.

It is to be understood that the above detailed description of an embodiment of the invention are provided by way of example only. Various details of design and construction may be modified without departing from the true spirit and scope of the invention as set forth in the appended claims.

The embodiments of the invention in which an exclusive property or privilege is claimed are defined as follows:

1. A first high voltage electrical connector element, such as a connector elbow, which is to be connected to a second high voltage electrical connector element, such as a bushing in a power distribution system, the first and second connector elements including first and second axially-extending interengageable surfaces, respectively, and first and second radially-extending surfaces, respectively, which will confront one another upon interengagement of the interengageable surfaces:

said first connector element including a housing member including at least a first part of insulating material, at least a portion of the first radially-extending surface provided by the first part; and an annular lip of insulating material integral with the first part of the housing member and extending axially beyond at least said portion of the first radially-extending surface, the lip intersecting the radially innermost portion of the first radially-extending surface at all circumferential locations thereof, the lip being flexible such that upon completion of the interengagement of the interengageable surfaces the lip will be flexed outwardly so as to extend radially between the confronting first and second radially-extending surfaces and at least partially fill any gap which would otherwise be therebetween.

2. The invention of claim 1 wherein the first part of the housing member is constructed of an insulating elastomeric material and the annular lip is unitary with the first part and has an inner axially-extending surface forming a continuous extension of the first axially-extending surface.

3. The invention of claim 1 or 2 wherein the first part of the housing member includes an axially-extending receptacle for receiving an axially-extending plug of the second connector element, the receptacle providing said first interengageable surface and the plug providing said second interchangegable surface.

4. The invention of claims 1 or 2 wherein the annular lip has a rounded tip.

5. The invention of claim 1 or 2 wherein:

the first radially-extending surface includes a radially-inner first portion and a radially-outer second portion, the radially-inner first portion being recessed axially relative to the radially-outer second portion to establish an annular pocket; and the axial length of the annular lip does not exceed that which will assure that upon completion of the connection the annular lip will not extend radially beyond the first portion of the radially-extending surface.

6. The invention of claim 5 wherein the radial thickness of the annular lip is approximately equal to the axial extent of the annular pocket.

7. The invention of claim 6 wherein the annular lip has a rounded tip.

* * * * *